US010115504B2

(12) United States Patent
Hiroshima

(10) Patent No.: US 10,115,504 B2
(45) Date of Patent: Oct. 30, 2018

(54) THIN-FILM RESISTOR AND METHOD FOR PRODUCING THE SAME

(71) Applicant: KOA CORPORATION, Ina-shi, Nagano (JP)

(72) Inventor: Yasushi Hiroshima, Nagano (JP)

(73) Assignee: KOA CORPORATION, Nagano (JP)

( * ) Notice: Subject to any disclaimer, the term of this patent is extended or adjusted under 35 U.S.C. 154(b) by 144 days.

(21) Appl. No.: 15/201,099

(22) Filed: Jul. 1, 2016

(65) Prior Publication Data

US 2017/0011826 A1 Jan. 12, 2017

(30) Foreign Application Priority Data

Jul. 7, 2015 (JP) ..... 2015-136373

(51) Int. Cl.

| | |
|---|---|
| ***H01C 7/06*** | (2006.01) |
| ***H01C 7/00*** | (2006.01) |
| ***H01C 7/04*** | (2006.01) |
| ***H01C 7/02*** | (2006.01) |
| ***H01C 17/12*** | (2006.01) |

(52) U.S. Cl.

CPC ..... *H01C 7/06* (2013.01); *H01C 7/006* (2013.01); *H01C 7/021* (2013.01); *H01C 7/022* (2013.01); *H01C 7/041* (2013.01); *H01C 7/042* (2013.01); *H01C 17/12* (2013.01)

(58) Field of Classification Search

CPC ..... H01C 7/06; H01C 7/006; H01C 7/021; H01C 7/022; H01C 7/041

USPC ..... 338/7, 9

See application file for complete search history.

(56) References Cited

U.S. PATENT DOCUMENTS

| | | | | |
|---|---|---|---|---|
| 2004/0239478 | A1* | 12/2004 | Amadon | H01C 7/006 338/308 |
| 2006/0290462 | A1* | 12/2006 | Beach | H01C 1/14 338/9 |
| 2010/0156588 | A1* | 6/2010 | Privitera | H01C 7/06 338/7 |
| 2012/0049324 | A1* | 3/2012 | Le Neel | H01L 21/76834 257/537 |

FOREIGN PATENT DOCUMENTS

| | | | | |
|---|---|---|---|---|
| CN | 102376404 A | | 3/2012 | |
| JP | 2002-141201 | * | 5/2002 | H01C 7/00 |
| JP | 2002-141201 A | | 5/2002 | |

OTHER PUBLICATIONS

Office Action, and English language translation thereof, in corresponding Chinese Application No. 201610525682.7, dated Jan. 17, 2018, 24 pages.

* cited by examiner

*Primary Examiner* — Kyung Lee
*Assistant Examiner* — Iman Malakooti
(74) *Attorney, Agent, or Firm* — Brinks Gilson & Lione

(57) ABSTRACT

Provided is a thin-film resistor that has a higher resistance value than the conventional thin-film resistors while retaining excellent TCR characteristics. The thin-film resistor includes a substrate, a pair of electrodes formed on the substrate, and a resistive film connected to the pair of electrodes. The resistive film includes a first resistive film and a second resistive film, the second resistive film having a different TCR from that of the first resistive film, and each of the first resistive film and the second resistive film contains Si, Cr, and N as the main components.

7 Claims, 11 Drawing Sheets

(h)

(i)

(a)

(b)

(c)

(d)

(e)

(f)

(g)

(h)

(i)

THIN-FILM RESISTOR AND METHOD FOR PRODUCING THE SAME

RELATED APPLICATIONS

The present application claims priority from Japanese patent application JP 2015-136373 filed on Jul. 7, 2015, the content of which is hereby incorporated by reference into this application.

BACKGROUND OF THE INVENTION

1. Field of the Invention

The present invention relates to a thin-film resistor and a method for producing the same.

2. Description of the Related Art

Resistors are used for many electronic devices such as personal computers and portable terminals. In particular, thin-film resistors with high reliability are required for automobiles, medical devices, and industrial machines such as robots.

Such resistors have been required to have reduced chip sizes with a reduction in the size of electronic devices in recent years, and even resistors with reduced chip sizes are required to have equal resistance values to those of the conventional resistors. To that end, reducing the thickness of a film of a resistive material or reducing the size of a resistor pattern (i.e., reducing the thickness of a line pattern) is considered. However, reducing the thickness of a film or reducing the thickness of a line pattern too much can decrease the long-term reliability and deteriorate the characteristics of the thin-film resistor. Therefore, it is basically necessary to obtain a resistive material with higher specific resistance (i.e., resistivity).

As a thin-film resistive material with high specific resistance, a material that contains chromium and silicon and also contains a valve metal or a transition metal added thereto is disclosed, for example (see Patent Document 1). Specifically, Patent Document 1 discloses a material that contains one or more of metals selected from Nb, Ta, Al, Cu, Mn, Zr, or Ni in addition to chromium and silicon. A target containing a thin-film resistive material is sputtered so that the material is deposited on the surface of a substrate as a resistive film. Sputtering is performed with a mixed gas of argon and nitrogen that are inert gases. Increasing the percentage of the nitrogen gas can form a resistive film with relatively high specific resistance.

The resistive film deposited on the substrate is patterned into a shape that can obtain approximately a desired resistance value through photolithography or the like, and the resistive film is then subjected to heat treatment under an inert gas atmosphere such as nitrogen or argon. Adequately setting the conditions of the heat treatment can obtain a low (approximately zero) temperature coefficient of resistance (TCR).

The thus produced resistive film exhibits a specific resistance of about several mΩ·cm, and has a resistance value of about several hundred kΩ·cm to 1 MΩ·cm as a thin-film resistor. Such a resistive film has a temperature coefficient of resistance TCR in the range of about ±25 ppm/° C., for example.

3. Related Art Documents

Patent Documents

Patent Document 1: JP 2002-141201 A

SUMMARY OF THE INVENTION

As described above, there has been a demand for increasing resistivity. As a method for increasing the specific resistance of a resistive film, there is known a method of increasing the amount of a nitrogen gas used for sputtering and thus increasing the amount of silicon nitride with high specific resistance.

However, a resistive film formed with such a method has a problem in that the characteristics of the negative TCR of the silicon nitride become dominant, and thus that if the specific resistance is attempted to be increased, it would be difficult to set the TCR to approximately zero.

It is an object of the present invention to provide a thin-film resistor that has a higher resistance value than the conventional thin-film resistors while retaining excellent TCR characteristics.

According to an aspect of the present invention, there is provided a thin-film resistor including a substrate, a pair of electrodes formed on the substrate, and a resistive film connected to the pair of electrodes. The resistive film includes a first resistive film and a second resistive film, the second resistive film having a different TCR from that of the first resistive film, and each of the first resistive film and the second resistive film contains Si, Cr, and N as the main components.

One of the first resistive film or the second resistive film preferably has a positive TCR value, and the other preferably has a negative TCR value.

The first resistive film and the second resistive film contain different percentages of silicon nitride across (on the two different sides of) xTCR (a threshold of silicon nitride, which may have some range) as a boundary, the xTCR being the percentage of silicon nitride at which a positive TCR changes to a negative TCR or a negative TCR changes to a positive TCR.

Each of the first resistive film and the second resistive film contains silicon nitride, and the percentage of Si that forms silicon nitride in the first resistive film relative to the entire Si contained in the first resistive film is preferably less than or equal to 63%, and the percentage of Si that forms silicon nitride in the second resistive film relative to the entire Si contained in the second resistive film is preferably greater than or equal to 68%.

In the first resistive film, chromium silicide crystallites are continuously formed and structured, and a network structure is thus formed with the crystallites joined together. Such a structure can realize a film with high conductivity and low sheet resistance. In the second resistive film, it is found that chromium silicide crystallites are individually dispersed to form a discontinuous structure. Such a structure can realize a film with low conductivity and high sheet resistance.

The second resistive film may contain added thereto at least one metal element selected from Ti, Zr, or Al. The metal element added is preferably contained at a percentage of 1 to 4 atm % relative to the entire second resistive film. Such elements are elements that will easily form nitride. Such elements are added to adjust the characteristics of the resistive film.

It is also possible to adjust the characteristics of the resistive film by adding as a main component an element that is unlikely to form nitride instead of Cr. For example, the present invention may be a thin-film resistor including a substrate, a pair of electrodes formed on the substrate, and a resistive film connected to the pair of electrodes. The resistive film may include a first resistive film and a second resistive film, the second resistive film having a different TCR from that of the first resistive film. The first resistive film may contain Si, Cr, and N as the main components, and the second resistive film may contain Si, N, and a metal element that is to form silicide but is unlikely to form nitride. The metal element is preferably at least one element selected from Mo, W, Fe, or Co.

According to another aspect of the present invention, there is provided a method for producing a thin-film resistor including a substrate, a pair of electrodes formed on the substrate, and a resistive film connected to the pair of electrodes, the method including forming a first resistive film containing Si, Cr, and N as the main components, and forming a second resistive film containing Si, Cr, and N as the main components in a stacked manner on the first resistive film. The first resistive film and the second resistive film are formed by sputtering in an atmosphere containing nitrogen, and the mixture ratio of the nitrogen is increased in forming one of the first resistive film or the second resistive film.

The present invention also provides a method for producing a thin-film resistor including a substrate, a pair of electrodes formed on the substrate, and a resistive film connected to the pair of electrodes, the method including forming a first resistive film containing Si, Cr, and N as the main components; and forming a second resistive film containing Si, Cr, and N as the main components in a stacked manner on the first resistive film. The first resistive film and the second resistive film are formed by sputtering in a gas containing nitrogen, and one of the first resistive film or the second resistive film is formed using a target containing at least one added metal element selected from Ti, Zr, or Al.

According to the present invention, a thin-film resistor can be provided that has a higher resistance value than the conventional thin-film resistors while retaining excellent TCR characteristics.

DETAILED DESCRIPTION OF THE PREFERRED EMBODIMENTS

In this specification, the phrase "containing Si (silicon), Cr (chromium), and N (nitrogen) as the main components" means that only Si, Cr, N are the elements that are intentionally contained as the components and the other components are so-called dopant components or unintended impurities that are contained at about 5 atm %, for example. In addition, although "sheet resistance" and "specific resistance (resistivity)" differ in practice, they have the same meaning as long as the film thickness is constant. Thus, such terms may be used interchangeably in this specification.

Hereinafter, a resistor and a method for producing the resistor in accordance with an embodiment of the present invention will be described in detail with reference to the drawings.

First Embodiment

Figure 1A:
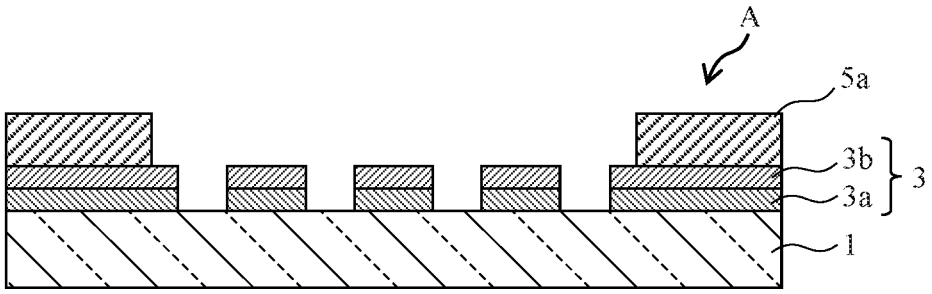
FIG. 1 are a cross-sectional view (FIG. 1A) illustrating an exemplary configuration of a thin-film resistor in accordance with a first embodiment of the present invention and a plan view (FIG. 1B) exemplarily illustrating the configuration.
Figure 1B:
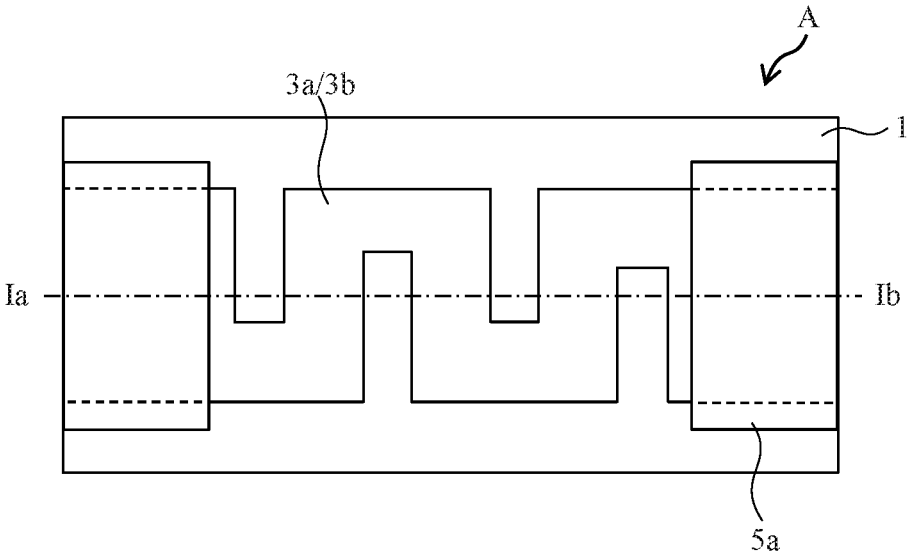

FIG. 1 are a cross-sectional view (FIG. 1A) illustrating an exemplary configuration of a thin-film resistor in accordance with a first embodiment of the present invention and a plan view (FIG. 1B) exemplarily illustrating the configuration. As illustrated in FIG. 1A (a cross-sectional view along line Ia-Ib of FIG. 1B) and FIG. 1B, a thin-film resistor A in accordance with this embodiment includes an insulating substrate 1 made of alumina, for example, a resistive film 3 (3*a*/3*b*) with at least a two-layer structure of a first resistive film 3*a* formed on the insulating substrate 1 and a second resistive film 3*b* formed on the first resistive film 3*a*, and an electrode 5*a* formed on a predetermined region of the resistive film 3.

The first resistive film 3*a* has a positive TCR value, and the second resistive film 3*b* has a negative TCR value. Further, the sheet resistance of the second resistive film 3*b* is higher than that of the first resistive film 3*a*. It should be noted that the first resistive film 3*a* and the second resistive film 3*b* may be arranged in any order in the vertical direction.

Hereinafter, a method for producing the resistor illustrated in FIG. 1 will be described with reference to FIGS. 2A to 2C.

Figure 2A:
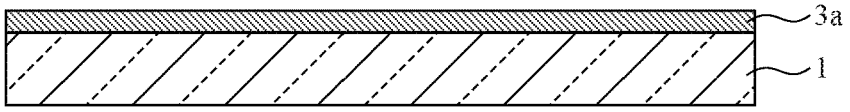
FIG. 2A are views illustrating an example of a method for producing the resistor illustrated in FIGS. 1A and 1B.
Figure 2A:
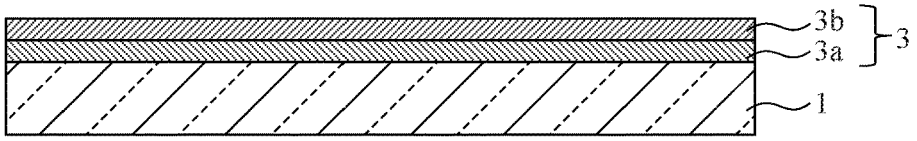
Figure 2A:
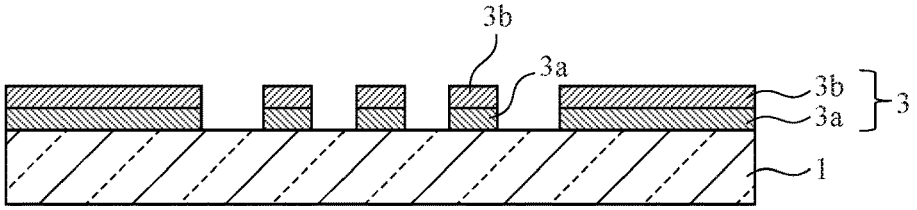
Figure 2A:
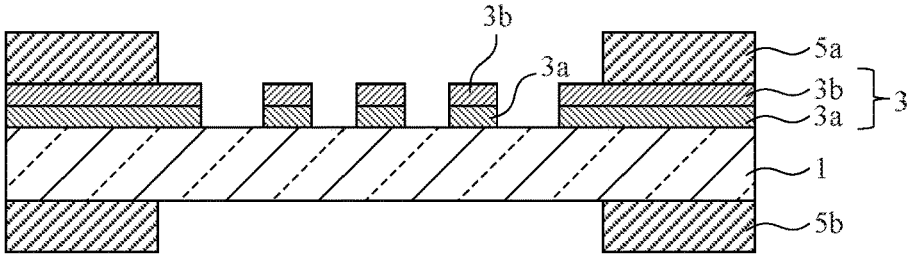

As illustrated in FIG. 2A(a), the substrate 1 with at least one insulating surface is loaded on a sputtering apparatus or the like, and the first resistive film 3*a* is deposited on the substrate 1. An alumina substrate, for example, can be used for the substrate 1. The sputtering technique will be described below.

The first resistive film 3*a* formed by sputtering has a thickness of about 30 to 150 nm, for example.

It should be noted that reducing the thickness of the resistive film more can also increase the sheet resistance of the resistive film and thus can increase the resistance value of the resulting resistor. However, as the surface of the substrate 1 has relatively large irregularities and a resistive film that is formed too thin on such surface is likely to be influenced by the variation in the thickness, the resistive film should have a certain thickness in order to produce a resistor stably.

Next, the second resistive film 3*b* is deposited on the first resistive film 3*a* (FIG. 2A(b)).

The second resistive film 3*b* in this embodiment is formed by sputtering a target containing chromium and silicon. The mixture ratio of nitrogen in the mixed gas used for sputtering is desirably set higher than that for forming the first resistive film 3*a*. That is, the nitrogen content (percentage) in the second resistive film 3*b* is higher than that in the first resistive film 3*a*. It should be noted that as the first resistive film 3*a* and second resistive film 3*b* may be arranged in any order in the vertical direction, it is also possible to increase the mixture ratio of nitrogen in forming the first resistive film 3*a*.

Next, the resistive film with the stacked first resistive film 3*a* and second resistive film 3*b* is patterned using a photolithography technique, for example, to obtain a resistive film pattern that can have an approximately desired resistance value after being subjected to the following heat treatment (FIG. 2A(c)).

Next, the substrate 1 with the resistive film pattern formed thereon is subjected to heat treatment under an inert gas atmosphere such as nitrogen or argon. The detailed conditions of the heat treatment step and the like will be described later.

The first resistive film 3*a* and the second resistive film 3*b* formed through the aforementioned steps each contain chromium, silicon, and nitrogen as the main components, and in each resistive film, chromium forms a compound (i.e., chromium silicide) with a part of silicon, while the other part of silicon forms nitride (i.e., silicon nitride).

The suitable percentage of silicon that forms nitride in the first resistive film 3*a* is about 50 to 63% of the entire silicon in the first resistive film 3*a* (the percentage of nitrogen in the first resistive film 3*a* is about 20 to 26 atm %), while the suitable percentage of silicon that forms nitride in the second resistive film 3*b* is 68 to 80% of the entire silicon in the second resistive film 3*b* (the percentage of nitrogen in the second resistive film is about 29 to 33 atm %).

As described above, the second resistive film 3*b* contains more nitrogen than does the first resistive film 3*a*, and thus has a higher percentage of nitrided silicon. Thus, the second resistive film 3*b* has higher specific resistance than the first resistive film 3*a*. Changing the thicknesses (t1 and t2) of the first resistive film 3*a* and the second resistive film 3*b* can change the sheet resistance Rs1 and the sheet resistance Rs2 of the respective films to a certain degree. The relationship between Rs1 and Rs2 will be described below.

Next, a base electrode is formed (FIG. 2A(d)). The base electrode 5*a* is formed by depositing copper, for example, on the surface of the substrate 1 using sputtering. Patterning of the base electrode 5*a* may be performed either by arranging a metal mask on the substrate 1 that has the pattern of the resistive thin film 3 formed thereon, or using a lift-off method with photoresist. Hereinafter, the lift-off method will be described as an example.

The substrate 1, which has the pattern of the resistive thin film 3 formed thereon, is coated with photoresist, which is then patterned. After that, the patterned surface of the resistive thin film is sputter-etched by about several nm using argon ions or the like. This step is performed to remove a natural oxide film formed on the surface of the resistive thin film in the heat treatment step and the like and thus obtain an excellent electrical conduction between the resistive thin film 3 and the base electrode 5*a*. Likewise, a base electrode 5*b* is also formed on the rear surface of the substrate 1 through sputtering using a metal mask or the like. Either the base electrode 5*a* or the base electrode 5*b* may be formed first. The thickness of copper is about 1 μm.

After that, the photoresist is peeled away using an organic solvent such as a release agent so that copper films are formed as the base electrode 5*a* and the base electrode 5*b* only in desired regions.

Figure 2B:
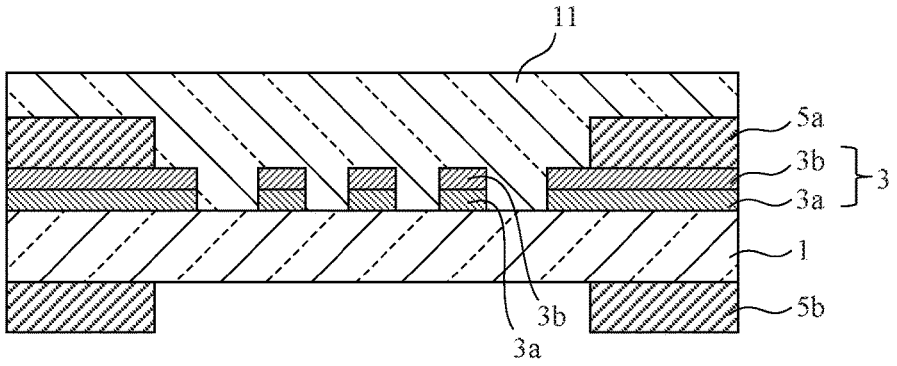
FIG. 2B are views continued from FIG. 2A.
Figure 2B:
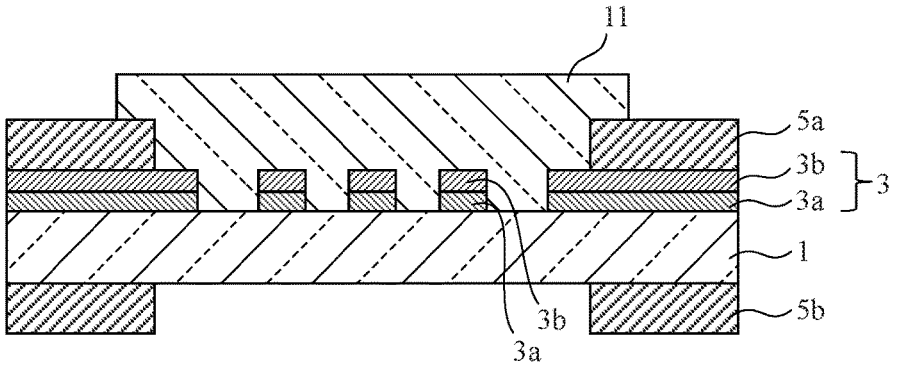
Figure 2B:
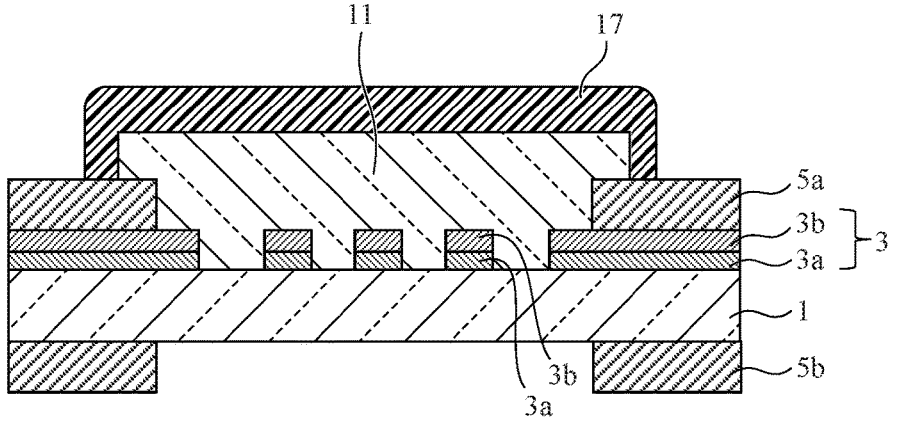
Figure 2C:
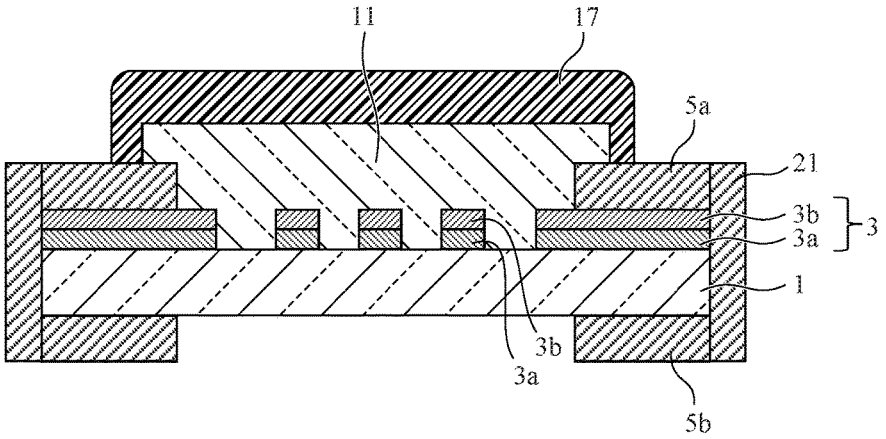
FIG. 2C are views continued from FIG. 2B.
Figure 2C:
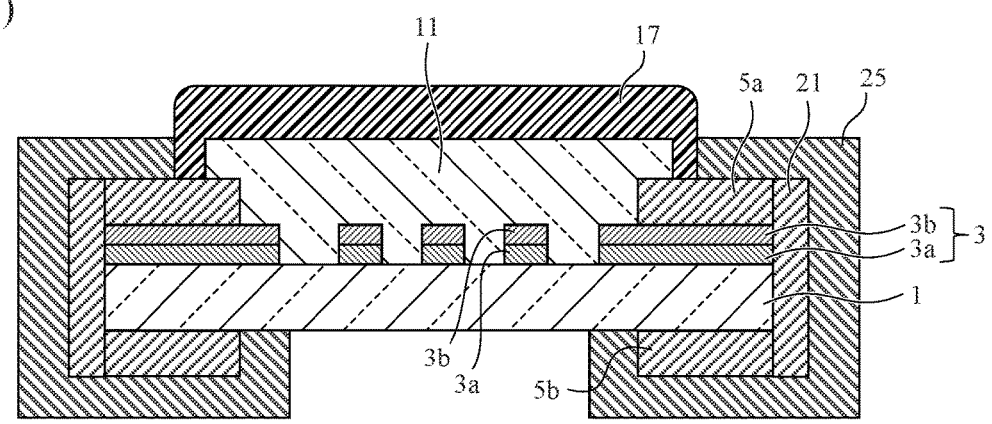

Next, a silicon oxide film 11 is formed as a protective film using a plasma CVD apparatus, for example, (FIG. 2B(e)). In this step also, a parallel-plate RF discharge apparatus can be used. $SiH_4$ and $N_2O$ gas can be used as a source gas. The thickness of the silicon oxide film is about 1 to 2 μm.

It is also possible to deposit a silicon nitride protective film using a plasma CVD apparatus before forming the silicon oxide film 11 as a protective film. Alternatively, it is also possible to deposit a silicon nitride protective film (not shown) using a plasma CVD apparatus after forming the protective film. In the step of forming a silicon nitride protective film, $SiH_4$, $NH_3$, or $N_2$ gas is used as a source gas.

The thickness of the silicon nitride protective film may be about 50 to 100 nm. As the silicon nitride protective film has lower moisture permeability than the silicon oxide film, it is possible to suppress intrusion of moisture even under a high-temperature, high-humidity environment.

After that, the protective film 11 (i.e., the silicon oxide film or a stacked film of the silicon oxide film and the silicon nitride film) is patterned using a photolithography technique so as to form an opening above at least the base electrode 5*a* (FIG. 2B(f)). Then, as illustrated in FIG. 2B(g), an overcoat film 17 is formed. The overcoat film 17 is a protective film of resin, for example, and can be formed through curing after being screen-printed, for example.

Next, a primary breaking process is performed to split the substrate 1 into strip-like chip groups. Then, an end-surface base electrode 21 is formed on an exposed end surface of the substrate (FIG. 2C(h)). Next, a secondary breaking process is performed to obtain individual chips, and nickel and tin plating is applied to the end-surface base electrode 21 as well as to the base electrodes 5*a* and 5*b* on the upper and rear surfaces of the substrate, whereby a thin-film resistor is completed (FIG. 2C(i)).

In order to form a resistive film, a sputtering technique is used, for example. When sputtering is performed using a target, a mixed gas that contains appropriate amounts of an inert gas and nitrogen is preferably used to obtain a film with high specific resistance.

Herein, a mixed gas of argon and nitrogen is used, and the mixture ratio (i.e., flow rate) of nitrogen in the gas may be set in the range of about 10 to 30%, for example.

Accordingly, a film that contains an appropriate amount of silicon contained in the target, which has been nitrided, is deposited on the substrate, and a resistive film is thus obtained. The suitable percentage of nitrogen contained in the first resistive film is about 20 to 26 atm %, and about 50 to 63% of silicon contained in the resistive film is preferably nitrided.

It should be noted that as the first resistive film and the second resistive film may be arranged in any order in the vertical direction, the mixture ratio of nitrogen may be adjusted such that the mixture ratio of nitrogen in the first resistive film 3*a* becomes higher than that in the second resistive film 3*b*.

At the percentage of the metal element and the percentage of the nitrogen gas used for sputtering, the second resistive film 3*b* has a negative TCR value and has about the same specific resistance as that of the first resistive film 3*a*. Accordingly, selecting an appropriate element within the range of the percentage can form the second resistive film 3*b* with desired characteristics.

(Detailed Description of Heat Treatment Step)

Hereinafter, the heat treatment step described briefly above will be described in detail. The substrate 1 that has the resistive film pattern 3 (3*b*/3*a*) formed thereon by sputtering or the like is subjected to heat treatment under an inert gas atmosphere such as nitrogen or argon, so that chromium and silicon contained in the first resistive film 3*a* and the second resistive film 3*b* are combined to form silicide crystallites. That is, performing heat treatment can obtain the resistive films 3*a*/3*b* with a structure in which silicide crystallites are dispersed in a matrix that contains amorphous silicon nitride as the main component.

The inventor has found through a research that such a structure is greatly related to the electrical characteristics (specific resistance or TCR) of the resistive films 3*a*/3*b*. Hereinafter, the process will be described.

The resistive films 3*a*/3*b* are amorphous before being subjected to heat treatment, and have negative TCR values at this time.

However, when heat treatment is performed at a temperature of greater than or equal to 500° C., chromium aggregates within the resistive films 3*a*/3*b* to form chromium silicide crystallites, so that phase separation occurs between the chromium silicide crystallites and the other matrix portion that contains silicon nitride as the main component.

Herein, chromium silicide has positive TCR characteristics, while silicon nitride that is a matrix has negative TCR characteristics.

If the heat treatment temperature is relatively low, chromium silicide crystallites are not formed sufficiently. Thus, the TCR characteristics of the entire resistive films remain negative. If the heat treatment temperature is increased, the formation of chromium silicide crystallites is promoted, and the TCR changes to a value of approximately zero or to a positive value.

When the heat treatment temperature is further increased, the formation of chromium silicide crystallites is further promoted, so that phase separation between the chromium silicide crystallites and the silicon nitride matrix portion is promoted. Electric charge preferentially moves through the chromium silicide crystallites with relatively low resistance. Thus, the characteristics of the chromium silicide dominate the TCR of the resistive films and thus change the TCR to a higher positive value. Concurrently, the portions of the chromium silicide crystallites aggregate and form a thin, long structure, which in turn increases the resistance of the films. The results of the detailed consideration will be described below.

Figure 3:
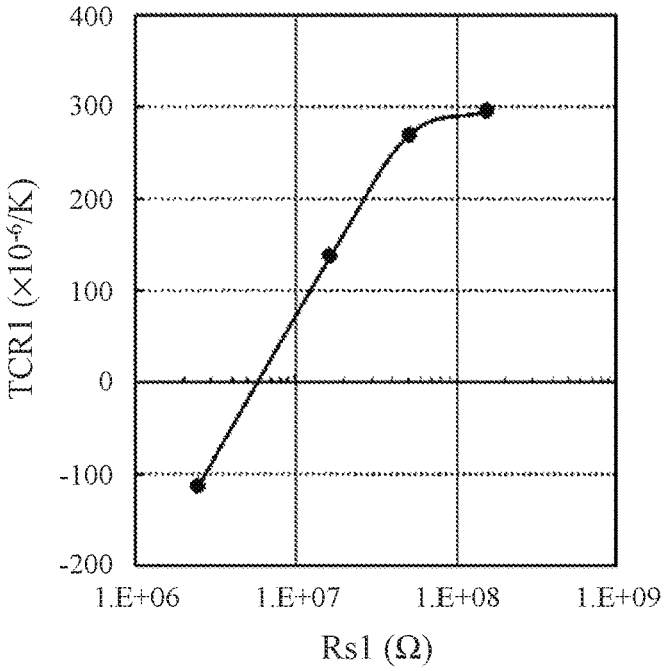
FIG. 3 is a graph illustrating the relationship between the sheet resistance Rs1 and TCR1 of a first resistive film.

FIG. 3 is a graph illustrating the relationship between the sheet resistance Rs1 and TCR1 of the first resistive film 3*a*. The abscissa axis represents the sheet resistance. The plots represent the values at the heat treatment temperatures of 650° C., 700° C., 750° C., and 800° C. in order from the left to the right of the abscissa axis. TCR1 increases to a positive value with an increase in the heat treatment temperature, and the sheet resistance Rs1 also increases at the same time. That is, the specific resistance ρ1=Rs1×t1 increases.

As is understood from FIG. 3, the first resistive film 3*a* has increased sheet resistance and an increased TCR with an increase in the heat treatment temperature. However, at a temperature greater than or equal to 750° C., the TCR changes little and becomes almost constant though it has a positive value. As described above, if heat treatment is performed in a region of up to the temperature region in which the TCR does not fluctuate any further in the production stage, it is possible to suppress the fluctuations in the TCR thereafter and thus obtain a resistor with a stable TCR as a whole.

By the way, in the conventional art where a resistive film has a single layer, heat treatment is performed to a target temperature at which the TCR characteristics become approximately zero. Thus, the obtained specific resistance has a relatively low value. In addition, as is understood from FIG. 3, there is a problem in that as the heat treatment temperature dependence of the TCR characteristics around a point where the TCR characteristics become approximately zero is relatively high, the TCR characteristics will greatly fluctuate with even a small change in the process conditions.

In this embodiment, heat treatment is performed at a temperature higher than that when a condition where the TCR characteristics become approximately zero is targeted as in conventional art. Accordingly, it is possible to form the first resistive film 3*a* that has sheet resistance ten times that of the conventional art and has positive TCR characteristics. As a change in the TCR characteristics in such heat treatment temperature region, in particular, in the heat treatment temperature region of greater than or equal to 750° C. is relatively gentle, variation in the TCR characteristics that depends on the process (heat treatment temperature) is small, and a resistive film with high sheet resistance can thus be obtained.

Figure 4:
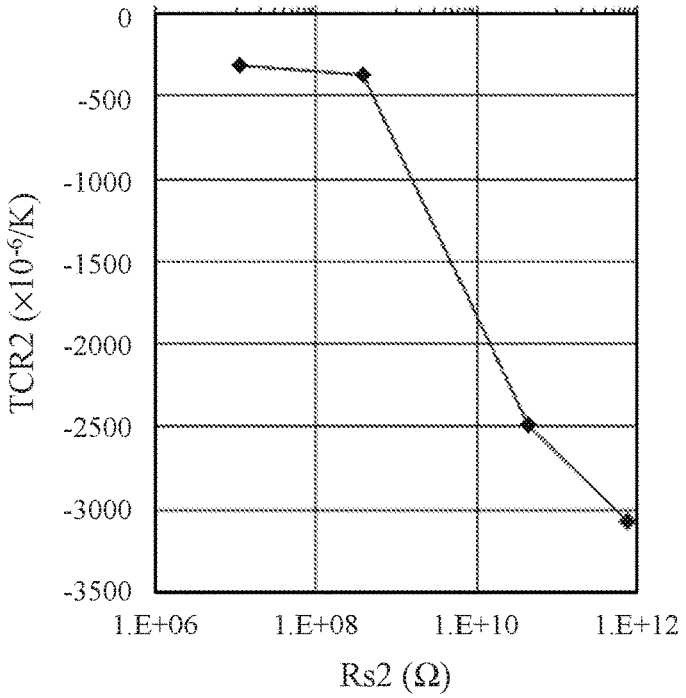
FIG. 4 is a graph illustrating the relationship between the sheet resistance Rs2 and TCR2 of a second resistive film.

FIG. 4 is a graph illustrating the relationship between the sheet resistance Rs2 and TCR2 of the second resistive film 3*b*. The plots represent the values at the heat treatment temperatures of 650° C., 700° C., 750° C., and 800° C. in order from the left to the right of the abscissa axis.

As is understood from FIG. 4, the second resistive film 3*b* has increased sheet resistance and a reduced TCR with an increase in the heat treatment temperature. The TCR has a negative value.

The percentage of nitrogen in the second resistive film 3*b* is increased than that in the first resistive film 3*a*. Thus, the percentage of a silicon nitride matrix that is formed in the second resistive film 3*b* after heat treatment is increased. Therefore, chromium silicide that is formed by heat treatment is individually scattered as crystallites with a size of about several nm to several tens of nm, and thus, a structure in which the crystallites are joined together is unlikely to be formed.

Consequently, electric charge flows not only through the chromium silicide crystallites but also through the silicon nitride portions (i.e., matrix region) between the crystallites. Thus, such electric charge is strongly influenced by the high specific resistance and the negative TCR characteristics of the region.

In this embodiment, the first resistive film 3*a* and the second resistive film 3*b* are stacked to obtain a resistive film with a high resistance value and TCR characteristics of around zero. The conditions will be described below.

The sheet resistance Rs1 of the resistive film 3, which is obtained by stacking the first resistive film 3*a* with the sheet resistance Rs1 and the second resistive film 3*b* with the sheet resistance Rs2, is represented by Formula (1) below as the combined resistance of the parallel connection of Rs1 and Rs2 of temperature T.

$$Rs = \frac{Rs1Rs2}{Rs1 + Rs2} \quad \text{Formula (1)}$$

As shown in Formula (1), the sheet resistance Rs of the stacked resistive film 3 is lower than the sheet resistance Rs1 of the first resistive film 3*a*. However, the first resistive film can have specific resistance that is about ten times that of the conventional resistive film produced under heat treatment conditions where the TCR characteristics become approximately zero (see FIG. 3).

Thus, as long as appropriate Rs2 is obtained, it is possible to realize the sheet resistance Rs that is sufficiently higher than that of the conventional single-layer structure.

When the proportion of Rs relative to Rs1 is generalized as n (0<n<1), it can be represented by Formula (2) below.

$$Rs = nRs1 = \frac{Rs1Rs2}{Rs1 + Rs2} \qquad \text{Formula (2)}$$

Formula (2) can be deformed into Formula (3).

$$\frac{n}{1-n}Rs1 = Rs2 \qquad \text{Formula (3)}$$

From such formula, it is found that in order to set Rs to be greater than or equal to a half of Rs1 (n≥0.5), it is acceptable as long as Rs1≤Rs2 is satisfied. In such a case, the sheet resistance Rs becomes about five times that of the conventional resistive layer with a single-layer structure. In addition, in order to set Rs to be greater than or equal to 95% of Rs1 (n≥0.95), it is acceptable as long as the composition (i.e., nitrogen content) and the film thickness of the second resistive film 3*b* are set such that 19Rs1≤Rs2 is satisfied. As described above, setting the composition (i.e., nitrogen content) and the film thickness of the second resistive film 3*b* can obtain the stacked resistive film 3 with desired sheet resistance.

Next, the resistance/temperature characteristics TCR of the stacked resistive film 3 will be described. It is assumed that the sheet resistance of the first resistive film 3*a* at a given temperature T is Rs1, the sheet resistance thereof at a temperature T+ΔT is Rs1+ΔRs1, and the temperature coefficient of resistance of the first resistive film 3*a* determined from such values is TCR1. The same applies to the second resistive film 3*b*.

The sheet resistance Rs at the temperature T of the stacked resistive film 3, which is obtained by stacking the first resistive film 3*a* and the second resistive film 3*b*, is represented by Formula (1) above, and similarly, the combined resistance Rs of the sheet resistance Rs1+ΔRs1 and Rs2+ΔRs2 at the temperature T+ΔT is represented by Formula (4) below.

$$Rs = \frac{(Rs1 + \Delta Rs1)(Rs2 + \Delta Rs2)}{Rs1 + \Delta Rs1 + Rs2 + \Delta Rs2} = Rs(T + \Delta T) \qquad \text{Formula (4)}$$

From the above, the variation amount Rs(T+ΔT)−Rs(T) of the combined resistance when the temperature is changed from T to T+ΔT is obtained as follows.

$$Rs(T + \Delta T) - Rs(T) = \frac{(Rs1Rs2 + Rs1\Delta Rs2 + Rs2\Delta Rs1 + \Delta Rs1\Delta Rs2)(Rs1 + Rs2) - Rs1Rs2(Rs1 + \Delta Rs1 + Rs2 + \Delta Rs2)}{(Rs1 + \Delta Rs1 + Rs2 + \Delta Rs2)(Rs1 + Rs2)} = \frac{Rs1^2\Delta Rs2 + Rs1\Delta Rs1\Delta Rs2 + Rs2^2\Delta Rs1 + Rs2\Delta Rs1\Delta Rs2}{(Rs1 + \Delta Rs1 + Rs2 + \Delta Rs2)(Rs1 + Rs2)}$$

By assigning this combined resistance Rs to the equation of TCR, the following equations are obtained.

$$\begin{aligned} TCR &= \frac{Rs(T + \Delta T) - Rs(T)}{(T + \Delta T) - T}\frac{1}{Rs(T)} \\ &= \frac{Rs1^2\Delta Rs2 + Rs1\Delta Rs1\Delta Rs2 + Rs2^2\Delta Rs1 + Rs2\Delta Rs1\Delta Rs2}{(Rs1 + \Delta Rs1 + Rs2 + \Delta Rs2)(Rs1 + Rs2)\Delta T}\frac{Rs1 + Rs2}{Rs1Rs2} \\ &= \frac{Rs1^2\Delta Rs2 + Rs2^2\Delta Rs1 + (Rs1 + Rs2)\Delta Rs1\Delta Rs2}{Rs1Rs2(Rs1 + \Delta Rs1 + Rs2 + \Delta Rs2)\Delta T} \\ &= \frac{Rs1\frac{\Delta Rs2}{Rs2} + Rs2\frac{\Delta Rs1}{Rs1} + (Rs1 + Rs2)\frac{\Delta Rs1}{Rs1}\frac{\Delta Rs2}{Rs2}}{(Rs1 + \Delta Rs1 + Rs2 + \Delta Rs2)\Delta T} \\ &= \frac{Rs1 \cdot TCR2 + Rs2 \cdot TCR1 + \Delta T(Rs1 + Rs2)TCR1 \cdot TCR2}{Rs1 + \Delta Rs1 + Rs2 + \Delta Rs2} \\ &= \frac{Rs1 \cdot TCR2 + Rs2 \cdot TCR1 + \Delta T(Rs1 + Rs2)TCR1 \cdot TCR2}{Rs1 + \Delta Rs1 + Rs2 + \Delta Rs2} \end{aligned}$$

Thus, the TCR of the stacked resistive film 3 is represented by Formula (5) below.

$$TCR = \frac{\left\{\frac{Rs1}{TCR1} + \frac{Rs2}{TCR2} + \Delta T(Rs1 + Rs2)\right\}TCR1TCR2}{Rs1 + \Delta Rs1 + Rs2 + \Delta Rs2} \qquad \text{Formula (5)}$$

Here, the following relationship is used (i=1, 2)

$$\frac{\Delta Rsi}{Rsi \cdot \Delta T} = TCRi$$

From Formula (5), it is found that in order to set the TCR of the resistive film 3 to approximately zero, it is acceptable as long as the number in brackets of the numerator of Formula (5) is set zero. Herein, when the temperature coefficient of resistance TCR2 of the second resistive film 3*b*, which has a negative value, is taken into consideration and n in Formula (3) is used, the conditions in which TCR=0 is satisfied can be represented by Formula (6).

$$|TCR2| = \frac{n\ TCR1}{(1-n) + \Delta T\ TCR1} \qquad \text{Formula (6)}$$

Figure 5:
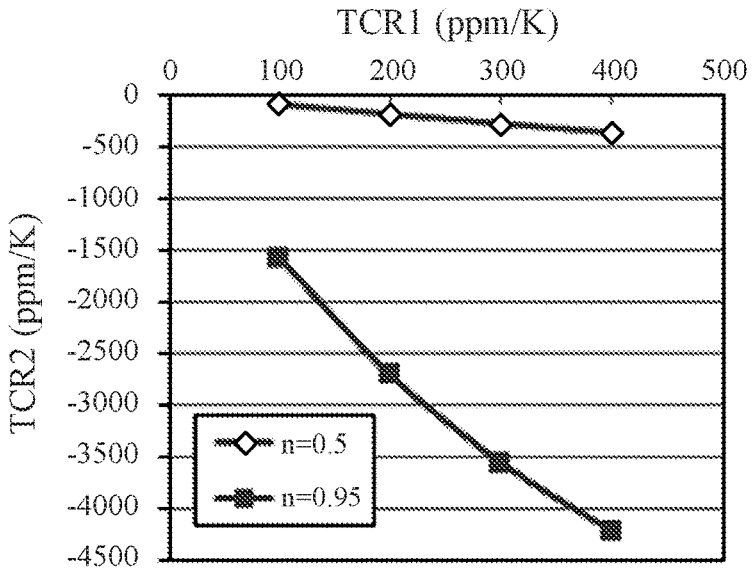
FIG. 5 is a graph illustrating an example of a change in TCR2 relative to TCR1.

FIG. 5 shows a change in TCR2 relative to TCR1 when ΔT=100 K, and n=0.5 and n=0.95, for example. FIG. 5 is a graph representation of Formula (6). Once TCR1 is determined, the value of TCR2 that should be taken in accordance with the value of n can be read from the abscissa axis of FIG. 5. In other words, the design principle about what relationship TCR1 and TCR2 should be designed to have is obtained in accordance with the value of n. It is found that when TCR1 of the first resistive film 3*a* illustrated in FIG. 5 is about 300 ppm/K, it is acceptable as long as TCR2 of the second resistive film 3*b* with a specific resistance of n=0.5 to 0.95 is −283 to −3563 ppm/K.

Figure 6:
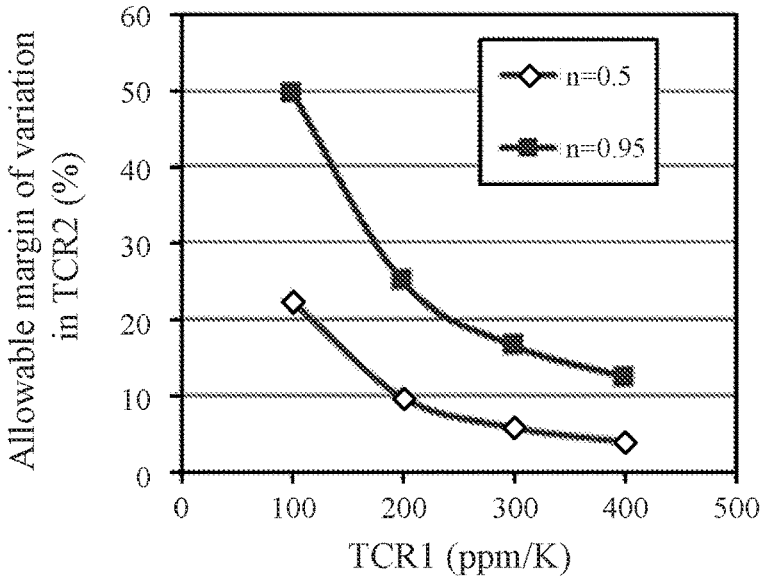
FIG. 6 is a graph illustrating the allowable margin of variation in TCR2 that allows the stacked resistive film to have a TCR value in the range of ±25 ppm/K and that is shown as a change relative to the value of TCR1.

FIG. 6 is a graph illustrating the allowable margin of variation in TCR2 that allows the stacked resistive film 3 to have a TCR value in the range of ±25 ppm/K and that is shown as a change relative to the value of TCR1.

FIG. 6 is a graph representation of Formula (5). When it is assumed that the resistive film 3 has variation in the TCR to a certain extent, it is found that the allowable margin of variation in TCR2 that is required of the second resistive film 3*b* can be made wide (large) by increasing the value of n. That is, it is possible to obtain a design principle such that designing the resistive film 3 to have a large n can reduce the influence on the TCR of the resistive film 3 (reduce the precision required of the second resistive film) even when TCR2 varies, and thus, production becomes easier.

For example, when n=0.95, the allowable margin of variation in TCR2 can be increased than when n=0.5. Thus, the production of the second resistive film 3*b* becomes easier.

From the results of the consideration above, in order to obtain desired sheet resistance Rs, appropriate Rs1 and n are determined in accordance with Formula (2). The value of n at this time is desirably as large as possible within the range of $0.5 \leq n < 1$. From the thus determined n and TCR1 that is obtained when the first resistive film 3*a* has Rs1, TCR2 may be determined in accordance with Formula (6), and the composition (i.e., nitrogen content) of the second resistive film 3*b* to be implemented may be designed.

Alternatively, it is also possible to determine the heat treatment conditions in accordance with Formula (6), taking into consideration TCR1 and TCR2 that change in accordance with the heat treatment conditions, within the range that $0.5 \leq n < 1$ is satisfied or preferably such that n becomes as large as possible. In accordance with the thus obtained n, the specific resistance and the film thickness of the first resistive film 3*a* and the specific resistance and the film thickness of the second resistive film 3*b* may be adjusted so that Rs1 and Rs2 satisfy the relationship of Formula (3).

Such heat treatment conditions are, for example, greater than or equal to 500° C. or desirably greater than or equal to 750° C. The upper limit is estimated to be 1000° C. If heat treatment is performed in a region of up to a temperature region where the TCR does not fluctuate any further in the production stage, it is possible to suppress the fluctuations in the TCR thereafter and thus obtain a resistive film with stable TCR as a whole.

When the first resistive film 3*a* and the second resistive film 3*b* are formed taking the above points into consideration, it is possible to obtain the resistive film 3 with higher sheet resistance than the conventional resistive films and with excellent temperature stability with a TCR of around zero. The design principle for the first resistive film 3*a* and second resistive film 3*b* can be determined in the above manner.

(Composition of Resistive Film)

Hereinafter, the compositions and the like of the first resistive film 3*a* and the second resistive film 3*b* will be discussed in detail.

The first resistive film 3*a* and the second resistive film 3*b* in accordance with this embodiment may have the same composition ratio of chromium and silicon, but differ in the nitrogen content (percentage). Accordingly, the percentage of silicon that forms nitride differs between the first resistive film 3*a* and second resistive film 3*b*.

The suitable percentage of silicon that forms nitride in the first resistive film 3*a* is about 50 to 63% of the entire silicon in the first resistive film 3*a* (the percentage of nitrogen in the first resistive film 3*a* is about 20 to 26 atm %), while the suitable percentage of silicon that forms nitride in the second resistive film 3*b* is about 68 to 80% of the entire silicon in the second resistive film 3*b* (the percentage of nitrogen in the second resistive film 3*b* is about 29 to 33 atm %).

The reason for setting the percentage of silicon in each resistive film in the aforementioned range is as follows.

When silicon nitride in the first resistive film 3*a* is less than less 50%, the sheet resistance (i.e., specific resistance) of the first resistive film 3*a* becomes too low relative to the target resistance value.

Meanwhile, when silicon nitride in the second resistive film 3*b* is greater than 80%, the material becomes close to an insulator. Thus, the specific resistance and the TCR of the second resistive film 3*b* become unlikely to act on (influence) the resulting resistor.

The value in the range of 63 to 68% that is between the percentage of silicon that forms nitride in the first resistive film 3*a* and the percentage of silicon that forms nitride in the second resistive film 3*b* is a value that depends on the phenomenon that the TCR changes from positive to negative at the value as the boundary. Such a nitrogen percentage is determined as xTCR.

Figure 7:
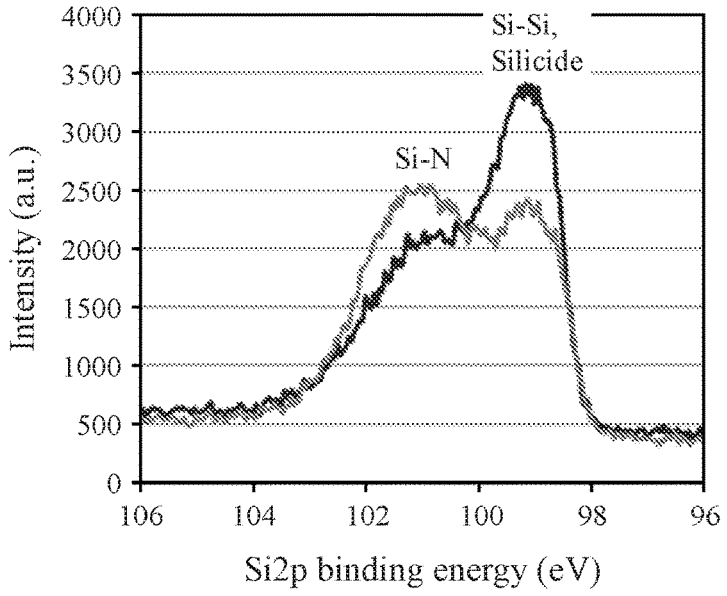
FIG. 7 is a graph illustrating the Si2p photo-electron spectrum of the first resistive film, where the abscissa axis represents the binding energy and the ordinate axis represents the spectrum intensity.

FIG. 7 is a graph illustrating the Si2p photo-electron spectrum of the first resistive film 3*a*, where the abscissa axis represents the binding energy and the ordinate axis represents the spectrum intensity.

As illustrated in FIG. 7, the first peak at around 99 eV results from Si that forms a Si—Si bond or silicide, and the second peak at around 101 to 102 eV results from silicon nitride (Si—N bond).

If the nitrogen content in the first resistive film 3*a* is increased, the first peak intensity becomes low and the second peak intensity becomes high. The ratio between the peak areas of the first peak and the second peak corresponds to the proportion of each bonding state. A spectrum having a peak on the low energy side is the data on a sample that contains 51% silicon nitride, and a spectrum having a peak on the high energy side is the data on a sample that contains 63% silicon nitride. The resistive film at this time exhibits a positive TCR.

The first resistive film 3*a* contains a relatively low percentage of silicon nitride. Therefore, a network structure is formed with chromium silicide crystallites joined together.

As described above, the first resistive film 3*a* has a network structure of chromium silicide (mainly, $CrSi_2$) formed in the SiN matrix. With such a structure, a film with high conductivity and low sheet resistance can be realized as shown in FIG. 3.

Figure 8:
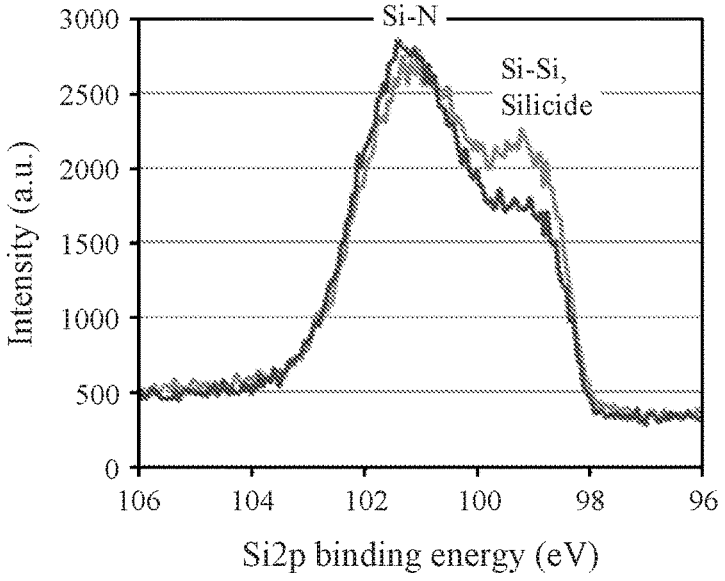
FIG. 8 is a graph illustrating the Si2p photo-electron spectrum of the second resistive film, where the abscissa axis represents the binding energy and the ordinate axis represents the spectrum intensity.

FIG. 8 is a graph illustrating the Si2p photo-electron spectrum of the second resistive film 3*b*, where the abscissa axis represents the binding energy and the ordinate axis represents the spectrum intensity.

As the second resistive film 3*b* has a high nitrogen content, the peak intensity of the second peak (i.e., a peak resulting from silicon nitride) at around 101 to 102 eV is higher than the peak intensity of the first peak at around 99 eV. FIG. 8 illustrates a sample that contains 68% silicon nitride and a sample that contains 77% silicon nitride. In the latter sample (77%), the intensity of the first peak at around 99 eV is relatively lower. The second resistive film 3*b* at this time exhibits a negative TCR.

It is found that as the second resistive film 3*b* contains a relatively high percentage of silicon nitride, chromium silicide crystallites are individually dispersed to form a discontinuous structure. With such a structure, a film with low conductivity and high sheet resistance can be realized as illustrated in FIG. 4.

Figure 9:
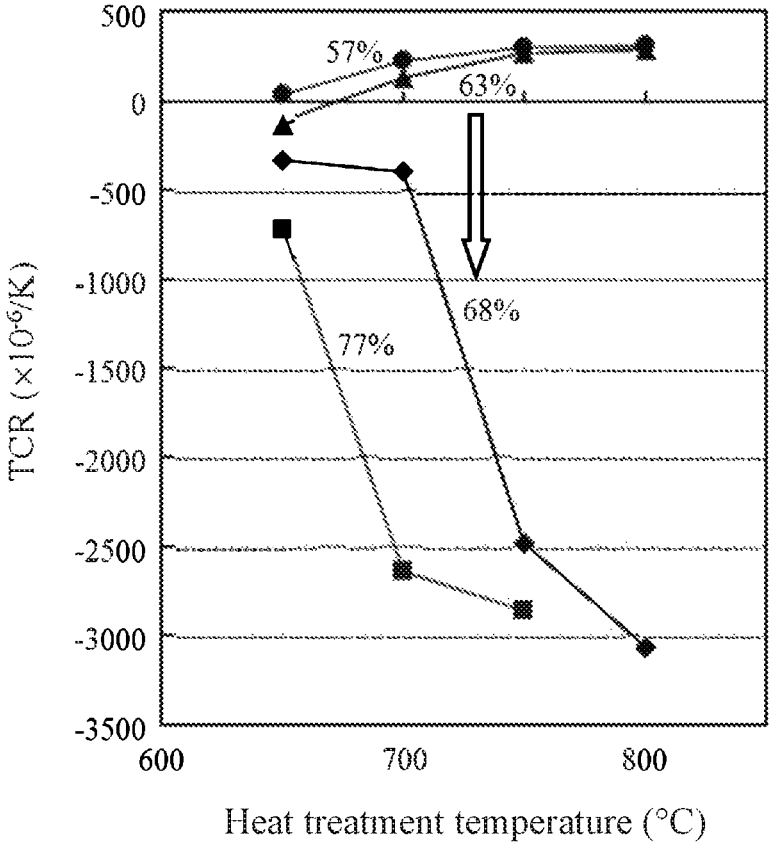
FIG. 9 is a view illustrating a change in the TCR relative to the heat treatment temperature of each resistive film in an embodiment that contains chromium, silicon, and nitrogen as the main components.

FIG. 9 is a view illustrating a change in the TCR relative to the heat treatment temperature of each resistive film in this embodiment that contains chromium, silicon, and nitrogen as the main components, where chromium in each resistive film forms a compound (i.e., chromium silicide) with a part of silicon, and a least a part of the remaining silicon forms nitride (i.e., silicon nitride).

With respect to the first resistive film 3*a* (● (black solid circle) and ▲ (black solid triangle)), the TCR changes in the positive direction with an increase in the heat treatment temperature. Meanwhile, with respect to the second resistive film 3*b* (◆ (black solid rhomboid) and ■ (black solid square)), the TCR changes in the negative direction with an increase in the heat treatment temperature.

Figure 10:
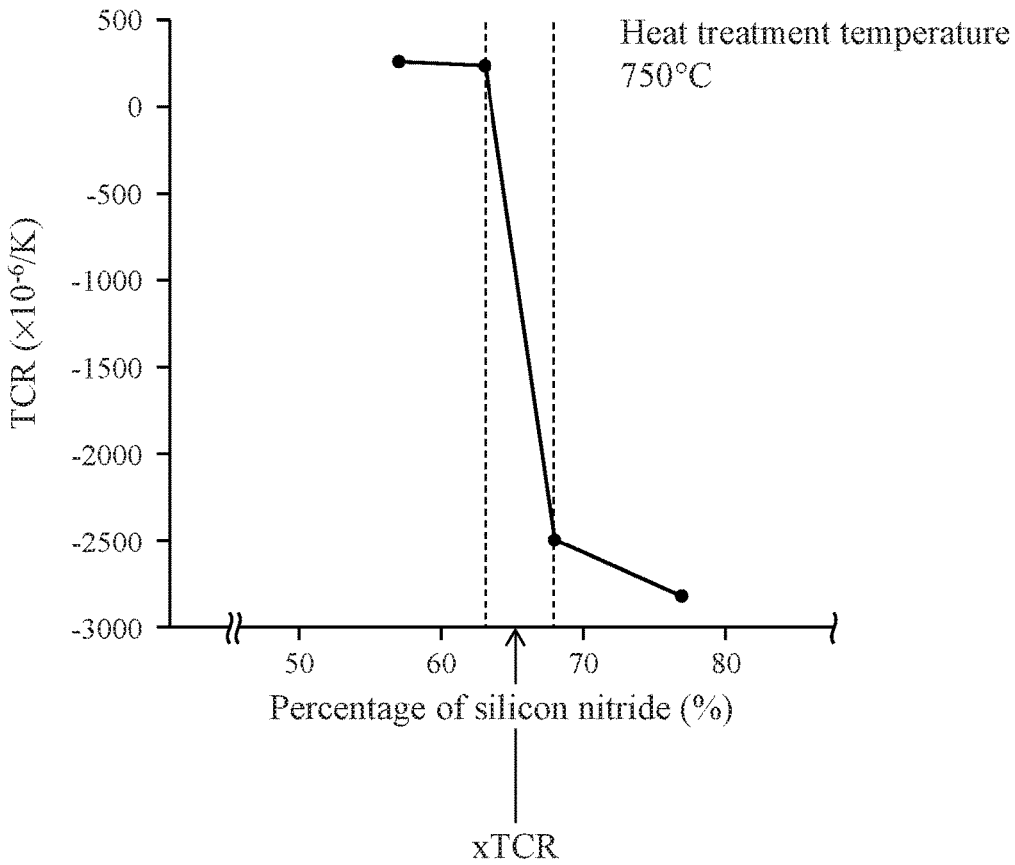
FIG. 10 is a view illustrating the relationship between the percentage of silicon nitride and the TCR.

Moreover, it was discovered that among such resistive films each containing chromium, silicon, and nitrogen as the main components, such a difference in the direction in which the TCR changes is generated abruptly when the percentage of silicon nitride is between 63 to 68% (see FIG. 10).

In this specification, the percentage of silicon nitride at which the direction in which the TCR changes is reversed in such a newly discovered phenomenon is referred to as xTCR (a threshold of the percentage of silicon nitride related to the TCR). Such xTCR is an important parameter that influences the sheet resistance-TCR characteristics of the two-layer resistive film in this embodiment.

With respect to such a phenomenon, the inventor has estimated the following mechanism so far.

(Estimation Mechanism)

In a resistive film that contains chromium, silicon, and nitrogen as the main components, the formation of chromium silicide crystallites in the resistive film is promoted with an increase in the heat treatment temperature. Chromium silicide has a positive TCR, and electric charge preferentially flows through such crystallites. Thus, the first resistive film 3*a* tends to exhibit a positive TCR with an increase in the heat treatment temperature.

However, if the nitrogen content in the resistive film is increased and the percentage of silicon nitride (matrix) is thus increased, a structure in which crystallites are individually dispersed is formed, in which case electric charge flows through the crystallites as well as the silicon nitride regions between the crystallites. As the silicon nitride regions have high resistance and a negative TCR, the characteristics of the resistive film change to negative.

Furthermore, as a change in the structure of the resistive film that depends on the silicon nitride content occurs uniformly across the entire film, the TCR will abruptly change even when there is a slight change in the nitrogen content (i.e., silicon nitride content) around xTCR.

As described above, the first and second resistive films with different TCRs are stacked. When a stacked resistive film of the first and second resistive films, which each contain Si, Cr, and N as the main components and contain different percentages of N, is used, it is possible to realize a resistive film that has a higher resistance value than the conventional resistive films and has a TCR of around zero. It is also possible to reduce the size of the resulting thin-film resistor.

It should be noted that the phrase "has a higher resistance value than the conventional resistive films" means that it is possible to realize a high resistance value three times or more that of a resistor with a (single-layer) resistive film that contains chromium, silicon, and nitrogen as the main components.

Second Embodiment

Next, a second embodiment of the present invention will be described. The first resistive film 3*a* in this embodiment is characterized by containing chromium, silicon, and nitrogen, and the second resistive film 3*b* is characterized by containing chromium, silicon, nitrogen, and a metal element (i.e., an added metal element) that will easily form nitride. Examples of the metal element that will easily form nitride include Ti, Zr, and Al.

When one of the aforementioned metal elements that will form nitride is added to a resistive film that contains chromium, silicon, and nitrogen, the specific resistance and the TCR characteristics of the resistive film will change.

For example, there is seen a tendency that when Nb, Ta, or the like is added, the specific resistance of the resistive film will decrease and the TCR will change in the negative direction.

Meanwhile, it was observed that in a resistive film that contains Ti, Zr, Al, or the like added thereto, the specific resistance changes only a little or does not change almost at all, and the TCR changes in the negative direction.

It is considered that such a difference in the change in the characteristics of the resistive films that depend on the added elements is related to how easily nitride of the added element can be formed. Ti, Zr, and Al are elements that can easily form nitride in comparison with Nb and Ta.

Figure 11:
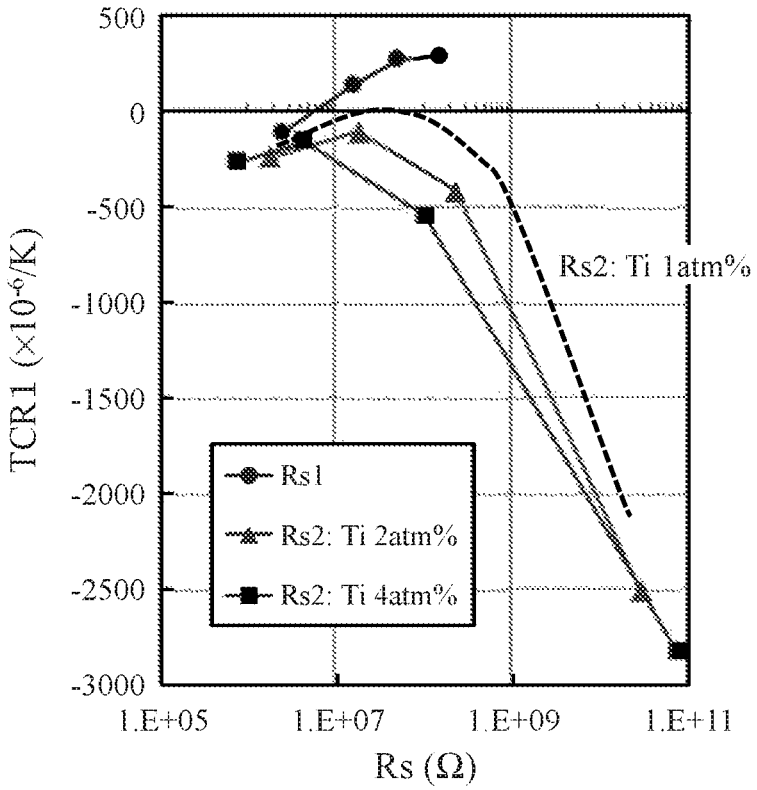
FIG. 11 is a view illustrating the relationship between the sheet resistance and the TCR of each of the first resistive film and the second resistive film.

As an example, FIG. 11 illustrates the relationship between the sheet resistance Rs2 and TCR2 of the second resistive film 3*b* containing Ti. FIG. 11 also illustrates the relationship between the sheet resistance Rs1 and TCR1 of the first resistive film 3*a*.

FIG. 11 illustrates both the characteristics of the first resistive film 3*a* (● (black solid circle)), which is the same as that in the first embodiment (FIG. 3), and the characteristics of the second resistive film 3*b* with Ti added thereto (▲ (black solid triangle) and ■ (black solid square)). As in FIG. 3, the heat treatment temperatures are 650° C., 700° C., 750° C., and 800° C. in order from the left to the right of the abscissa axis. The amounts of Ti added are 0 atm % (Rs1: ●), 2 atm % (Rs2: ▲), and 4 atm % (Rs2: ■). It should be noted that the characteristics of when 1 atm % Ti is added are the expected values (i.e., interpolated values). The value 1 atm % corresponds to the minimum added amount at which the TCR has a negative value.

It is found that a resistive film with Ti added thereto has negative TCR characteristics. It is also found that such characteristics change in accordance with the amount of Ti added.

The percentage of a nitrogen gas contained in the sputtering gas ($Ar+N_2$ gas) used for forming the first resistive film 3*a* and that for forming the second resistive film 3*b* are preferably the same. In such a case, it is also possible to, by disposing a target for the first resistive film and a target for the second resistive film in a sputtering apparatus housing a plurality of targets, and allowing a substrate to pass through a region around each target, consecutively form the first resistive film 3*a* and the second resistive film 3*b* in an approximate vacuum. For example, when a target for the second resistive film 3*b*, which contains added thereto an element that will easily form nitride, is disposed in a sputtering apparatus and sputtering is performed in an atmosphere that contains argon and nitrogen at an appropriate mixture ratio, the first resistive film 3*a* will have a positive TCR and the second resistive film 3*b* will have a negative TCR. Thus, it becomes easier to form a resistor as described above.

When such a method is used, the first resistive film 3*a* and the second resistive film 3*b* are consecutively formed in an approximate vacuum. Therefore, there are advantages in that the interface between the first resistive film 3*a* and the second resistive film 3*b* is kept clean, and the throughput of the production steps can be improved.

When such a metal element is added, the specific resistance (i.e., sheet resistance) will also change. The amount of the metal element added that does not cause a significant reduction in the specific resistance due to the addition is desirably in the range of about 1 to 4 atm %. As long as the added amount is within such a range, it is possible to adjust the specific resistance and the TCR characteristics of the second resistive film 3*b* with high accuracy by changing the amount of the metal element added.

Figure 12:
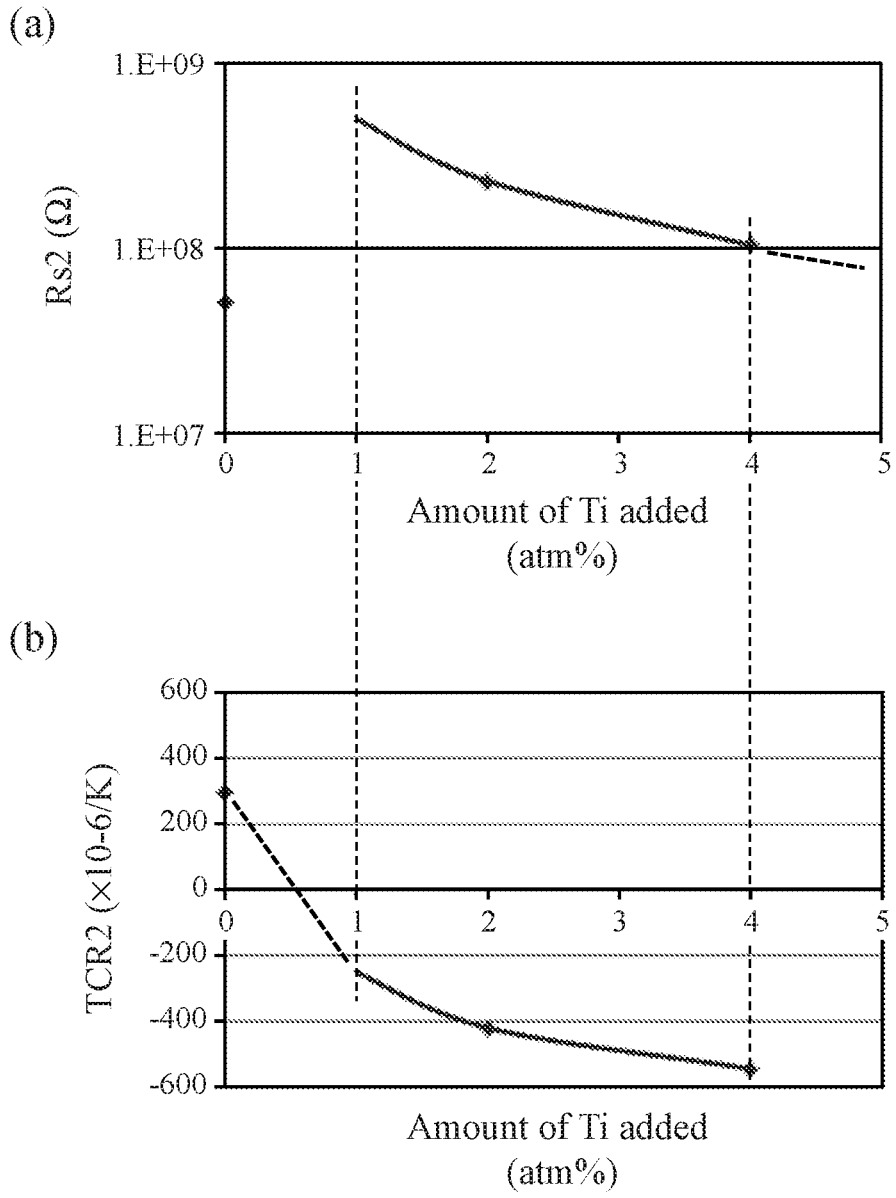
FIG. 12 are views illustrating changes in the sheet resistance Rs2 (FIG. 12A) and TCR2 (FIG. 12B) relative to the amount of Ti added, respectively.

FIG. 12 are views illustrating changes in the sheet resistance Rs2 (FIG. 12A) and TCR2 (FIG. 12B) relative to the amount of Ti added, respectively.

When the amount of Ti added is greater than or equal to 4 atm %, the sheet resistance Rs2 will decrease, while when the amount of Ti added is less than or equal to 1 atm %, the TCR2 will have a positive value. Thus, the amount of Ti added to the second resistive film 3*b* is preferably between 1 and 4 atm %. In this embodiment, xTCR can be adjusted by adding such elements.

As described above, according to this embodiment, it is possible to easily set the TCR value to approximately zero while suppressing the fluctuations in the sheet resistance only by adding one of the aforementioned metal elements, which will form nitride, in an appropriate quantity, to a resistive film that contains chromium, silicon, and nitrogen.

It should be noted that as described above, the percentage of a nitrogen gas contained in the sputtering gas used for forming the first resistive film 3*a* and that for forming the second resistive film 3*b* are preferably the same.

Third Embodiment

Next, a third embodiment of the present invention will be described. The first resistive film in this embodiment is characterized by containing chromium, silicon, and nitrogen, and the second resistive film is characterized by containing silicon, nitride, and a metal element that will form silicide but is unlikely to form nitride. As a metal element that will form silicide but is unlikely to form nitride, Mo, W, Fe, and Co can be used. When a second resistive film containing such a metal element is formed and is subjected to heat treatment, silicide of the metal element is formed in the resistive film.

The inventor studied and found that the specific resistance (i.e., sheet resistance) and the TCR characteristics of the second resistive film will change in accordance with the type and the amount of a metal element used. In order to realize a resistive film with about the same specific resistance as that when chromium is used as in the first and second embodiments, the percentage of a metal element that will form silicide but is unlikely to form nitride is desirably between about 15 and 22 atm %.

In this embodiment, an element that is unlikely to form nitride and will easily form silicide, like chromium, is used as a substitute element for chromium for the second resistive film 3*b*. That is, the second resistive film 3*b* does not contain chromium. xTCR can be adjusted with such a substitute element.

Further, the percentage of a nitrogen gas contained in the sputtering gas used for forming the first resistive film and that for forming the second resistive film are preferably the same. Accordingly, advantages that are similar to those described in the second embodiment are provided.

The percentage of a metal element that will form silicide but is unlikely to form nitride as well as the percentage of a nitrogen gas used for sputtering is preferably set at a level that allows the second resistive film to have a negative TCR value and have about the same specific resistance as that of the first resistive film.

When an appropriate element is selected within the range of the percentage, a second resistive film with desired characteristics can be formed.

Using an oxygen gas instead of a nitrogen gas also has a possibility that similar advantageous effects may be obtained.

In the aforementioned embodiments, configurations and the like that are illustrated in the attached drawings are not limited thereto, and can be changed as appropriate within the range that the advantageous effects of the present invention can be exerted. Besides, such configurations and the like can be changed as appropriate within the scope of the object of the present invention. Although a two-layer stacked structure has been exemplarily described above as the structure of the resistive film, the stacked structure may have three or more layers.

Although examples of the application of the present invention to a chip resistor formed of a resistive film have been described above, the present invention can also be applied to a variety of components, such as an integrated circuit that uses a resistor.

Each constituent element of the present invention can be selected or not selected as appropriate, and an invention that has the selected elements is also encompassed by the present invention.

The present invention is applicable to a resistor.

What is claimed is:

1. A thin-film resistor comprising a substrate, a pair of electrodes formed on the substrate, and a resistive film connected to the pair of electrodes, wherein the resistive film includes a first resistive film and a second resistive film, the second resistive film having a different TCR from that of the first resistive film, and each of the first resistive film and the second resistive film contains Si, Cr, and N as main components, and further wherein one of the first resistive film or the second resistive film has a positive TCR value, and the other has a negative TCR value, and the first resistive film and the second resistive film contain different percentages of silicon nitride across xTCR (a threshold of silicon nitride) as a boundary, the xTCR being a percentage of silicon nitride at which a positive TCR changes to a negative TCR or a negative TCR changes to a positive TCR.

2. The thin-film resistor according to claim 1, wherein the second resistive film contains added thereto at least one metal element selected from Ti, Zr, or Al.

3. The thin-film resistor according to claim 2, wherein the at least one metal element added is contained at a percentage of 1 to 4 atm % relative to an entirety of the second resistive film.

4. The thin-film resistor according to claim 1, wherein the first resistive film contains Si, Cr, and N as main components, and the second resistive film contains Si, N, and a metal element that is to form silicide but is unlikely to form nitride.

5. The thin-film resistor according to claim 2, wherein the at least one metal element comprises at least one element selected from Mo, W, Fe, or Co.

6. A method for producing a thin-film resistor including a substrate, a pair of electrodes formed on the substrate, and a resistive film connected to the pair of electrodes, the method comprising:

forming a first resistive film containing Si, Cr, and N as main components;

forming a second resistive film containing Si, Cr, and N as main components in a stacked manner on the first resistive film; and performing a thermal treatment at a temperature above 750° C. to adjust TCR values of the first and second resistive films substantially equal to zero, wherein the first resistive film and the second resistive film are formed by sputtering in an atmosphere containing nitrogen, wherein a flow ratio of nitrogen is between 10 to 30%, and a mixture ratio of the nitrogen is increased in forming one of the first resistive film or the second resistive film.

7. A thin-film resistor comprising a substrate, a pair of electrodes formed on the substrate, and a resistive film connected to the pair of electrodes, wherein the resistive film includes a first resistive film and a second resistive film, the second resistive film having a different TCR from that of the first resistive film, and each of the first resistive film and the second resistive film contains Si, Cr, and N as main components, and further wherein each of the first resistive film and the second resistive film contains silicon nitride, and a percentage of Si that forms silicon nitride in the first resistive film relative to the entire Si contained in the first resistive film is less than or equal to 63%, and a percentage of Si that forms silicon nitride in the second resistive film relative to the entire Si contained in the second resistive film is greater than or equal to 68%.

* * * * *